US005839352A

United States Patent [19]

Ribeiro et al.

[11] Patent Number: 5,839,352

[45] Date of Patent: Nov. 24, 1998

[54] ARTICULATED PISTON

[75] Inventors: Carmo Ribeiro, Ann Arbor, Mich.; Marcos Clemente, Sao Caetano Do Sul, Brazil; Alan S. Brown, Saline, Mich.; Norbert Abraham, Sr.; Kristopher R. Bare, both of Columbus, Ind.

[73] Assignee: Cummins Engine Company, Inc., Columbus, Ind.

[21] Appl. No.: 689,244

[22] Filed: Aug. 7, 1996

[51] Int. Cl.[6] ..... F01B 31/08

[52] U.S. Cl. ..... 92/186; 92/190; 123/193.6

[58] Field of Search ..... 92/153, 179, 186, 92/190, 222; 123/193.6

[56] References Cited

U.S. PATENT DOCUMENTS

| | | |
|---|---|---|
| Re. 34,139 | 12/1992 | Cooper et al. . |
| 4,056,044 | 11/1977 | Kamman et al. . |
| 4,180,027 | 12/1979 | Taylor . |
| 4,207,808 | 6/1980 | Elsbett et al. . |
| 4,286,505 | 9/1981 | Amdall . |
| 4,517,930 | 5/1985 | Nakano et al. . |
| 4,847,964 | 7/1989 | Adams et al. . |
| 4,867,119 | 9/1989 | Cooper et al. . |
| 4,941,440 | 7/1990 | Weber et al. . |
| 4,986,167 | 1/1991 | Stratton et al. . |
| 5,040,454 | 8/1991 | Balheimer et al. . |
| 5,042,364 | 8/1991 | Okamura et al. . |
| 5,054,375 | 10/1991 | Kawabata et al. . |
| 5,070,768 | 12/1991 | Goncalves et al. . |

(List continued on next page.)

FOREIGN PATENT DOCUMENTS

| | | |
|---|---|---|
| 0464626A1 | 6/1991 | European Pat. Off. . |
| 894542 | 12/1949 | France . |
| 550963 | 5/1932 | Germany . |
| 1261020 | 3/1968 | United Kingdom . |
| 1256242 | 9/1968 | United Kingdom . |
| 2220727 | 1/1990 | United Kingdom . |
| 2225087 | 5/1990 | United Kingdom . |
| WO 8002308 | 10/1980 | WIPO . |
| WO 95/29332 | 11/1995 | WIPO . |

OTHER PUBLICATIONS

United Kingdom Search Report dated Oct. 7, 1997.

*Primary Examiner*—Hoang Nguyen

*Attorney, Agent, or Firm*—Sixbey, Friedman, Leedom & Ferguson, P.C.; Charles M. Leedom, Jr.; Donald R. Studebaker

[57] ABSTRACT

An articulated piston for use in heavy duty diesel engines including a piston crown having an outer surface, a peripheral pending side wall and an inner surface having a pair of pin bosses extending downwardly from the inner surface with the inner surface and the pin bosses defining a hollow cooling cavity opening downwardly and extending about a circumference of the piston crown and a piston skirt with the piston skirt including a first longitudinal plane containing a pair of diametrically opposed bores for receiving a wrist pin for connection to the bosses of the crown and defining two semi-cylindrical thrust and non thrust surfaces of the skirt with a thickness of the non thrust surface being less than a thickness of the thrust surface and a second longitudinal plane, perpendicular to the first plane thereby dividing the piston skirt into four peripheral quarters. At least one of the quarters containing a cooling medium inlet through which a cooling medium, injected by a nozzle, can pass and impinge against the hollow cavity of the piston crown for cooling the crown. The piston skirt also includes a recessed tray formed in an upper surface of the skirt facing upwardly and opening toward the hollow cavity with the recessed tray extending for at least the peripheral quarter containing the cooling medium inlet and defined by a pair of substantially axially disposed side walls and a bottom wall extending radially inwardly between the side walls. The recessed tray is peripherally inclined towards a quarter diametrically opposed to the cooling medium inlet for conveyance of the cooling medium collected from the hollow cavity of the crown.

24 Claims, 4 Drawing Sheets

U.S. PATENT DOCUMENTS

| | | | |
|---|---|---|---|
| 5,086,736 | 2/1992 | Wiemann . | |
| 5,115,726 | 5/1992 | Daxer et al. | 92/190 X |
| 5,144,884 | 9/1992 | Kelly . | |
| 5,261,363 | 11/1993 | Kemnitz | 92/186 X |
| 5,279,268 | 1/1994 | Brink et al. . | |
| 5,289,758 | 3/1994 | Berlinger . | |
| 5,307,732 | 5/1994 | Berlinger . | |
| 5,357,920 | 10/1994 | Kemnitz et al. | 92/186 X |
| 5,546,896 | 8/1996 | Zaiser | 92/186 X |

ARTICULATED PISTON

TECHNICAL FIELD

The present invention relates to articulated engine pistons, particularly to the shape of a piston skirt which is generally articulately connected to a piston crown and a small end of a piston rod by way of a common wrist pin.

BACKGROUND OF THE INVENTION

Competitive pressures have increased the reliability and durability requirements for heavy duty diesel engines. In addition, performance and exhaust emission improvements have increased the thermal and mechanical loading on critical heavy duty diesel engine components.

To meet such requirements, the use of articulated pistons has grown in recent years. Conventional articulated pistons generally comprise a piston crown having an outer combustion chamber and, for cooling the crown, an inner hollow cooling cavity between the combustion chamber and a peripheral pending leg outwardly receiving piston rings. Such a piston is illustrated in U.S. Pat. No. 5,279,268 issued to Brink et al.

For the purpose of improving the cooling properties at the piston crown, a tray or trough is provided at the upper portion of the piston skirt, such a tray being open towards the hollow cavity so as to partially close this cavity, thus forming what is known as a cooling gallery. When the engine is running, a cooling liquid such as lubricating oil is injected by a nozzle against the hollow cavity, through an oil inlet provided axially along the tray, thus partially removing heat from that region. The oil impinged against the hollow cavity flows down and is collected by the tray. Due to the reciprocating motion of the piston oil collected from the cavity is shacked against and around this cavity thereby increasing the removal of heat from that region.

A like assembly of piston crown and piston skirt are disclosed in many prior letters patents granted the assignee, Cummins Engine Company, such as U.S. Pat. No. 5,144,884 issued to Kelly, while a variety of piston crown portions are disclosed, among others, in U.S. Pat. No. 5,459,922.

Although the above-noted articulated pistons exhibit good performance even when operating at severe conditions, specially with regards to the temperature and pressure which can be very high and often times run at a very high speed in modern Diesel engines, there has been a need to achieve an articulated piston assembly of greater thermal and motional equalization.

Thermal equalization as used here and throughout the specification refers to a more uniform cooling of the piston crown while motional equalization is intended to include a more appropriate structure in terms of resistance and reduced weight to withstand the mechanical loads as well as a more controlled tilting motion (lateral and rotational movements) of the skirt during the engine operation, rendering thereby an increased service life for such a component and the respective engine as well.

Referring firstly to thermal equalization, applicants noticed that a serious concern with respect to the cooling provided on the crown is the uneven heat removal around the cooling cavity, what leads some regions of the crown to work in temperatures which are higher than desirable thus reducing its service life. One of the facts generating this unfavorable scenario arises from the baseline of the majority of the engines employing articulated pistons which include only one cooling nozzle at the crankcase.

In like engines, the cooling oil is impinged by the nozzle against only a minor portion of the hollow cooling cavity of the crown which is covered by the oil spray. Therefore, the oil to be collected by the tray for the shaking will also be present in only a minor portion of the tray, causing the cocktail shaking to be inefficient in the remaining peripheral portions of the crown. In this instance, the piston is subject to a premature fail, most often in the region of either the peripheral pending leg or at the rim of the combustion chamber. Particularly, it was noticed that regions of the piston crown diametrically opposed to the cooling oil inlet were not cooled to the extent that those onto which oil is directly impinged by the nozzle because the oil spray does not reach such portions and, in addition, the respective portions of the tray thereunder receive only a little amount of oil for the shaking.

One possible solution for equalizing the cooling could be increasing the number of cooling nozzles so that a greater amount of cooling oil could be impinged against a greater surface of the hollow cooling cavity and hence collected by the tray for the shaking action. However, this solution is disadvantageous in that the cost of the engine by the incorporation of the additional nozzle would be increased. Further, this solution would require the use of a more powerful oil pump which decreases the power made available by the engine and likewise increase costs. With respect to the equalization of the piston motion, when a piston of the articulated type is travelling in pendular motion in the associated cylinder, the piston is guided substantially by the skirt at surfaces known as thrust and non thrust surfaces, each of these defined by the skirt length perpendicularly to the piston pin axis. It was noticed that the loads received by skirt at the non thrust surface are substantially less than the loads received by thrust surface. Therefore, known articulated piston skirts which are generally symmetrical in relation to the pin axis have shown as being quite over dimensioned at the non thrust surface with regards to structural resistance and consequently over weight. The inappropriate shape of the skirt makes the articulated piston heavy and creates secondary undesirable movements of the skirt, which tends to increase the power loss of the engine. In this regard, the majority of the skirts for articulated pistons are obtained by gravity casting a light alloy, e.g., an aluminum alloy. Despite being a relatively inexpensive method for the production of an articulated piston skirt, as broadly known, the skirts made according to this method may present undesirable porosity at portions with great thickness which ultimately reduces its service life.

Accordingly, there is a pressing need for an articulated piston having a piston skirt which leads itself to increasing the service life of the articulated piston as well as the engine as a whole. This is achieved by providing an articulated piston assembly and more specifically a piston skirt which exhibits greater thermal and motional equalization.

SUMMARY OF THE INVENTION

A primary object of the present invention is to overcome the aforementioned shortcomings associated with prior art articulated piston assemblies.

A further object of the present invention to provide an articulated piston having an associated skirt including an effective design solution which increases reliability and durability of the assembly without sacrificing cost, thus overcoming all the aforementioned insufficiencies.

It is a further object of the present invention to provide an articulated piston having improved thermal equalization.

Yet another object of the present invention to provide an articulated piston which exhibits improved motional equalization.

A still further object of the present invention is to provide an articulated piston which exhibits improved thermal equalization and improved motional equalization while being produced by a gravity die casting process.

These, as well as additional objectives of the present invention, are attained by an articulated piston comprising a piston crown of a cylindrical shape having a combustion chamber and an inner surrounding hollow cavity between the combustion chamber and an outer peripheral pending leg outwardly bearing the piston rings. The cooling of the piston crown is improved by providing trays at the upper portion of the piston skirt, such trays being open towards the hollow cavity so as to partially close the cavity forming thereby a cooling gallery into which a cooling liquid such as oil is injected by a cooling nozzle suitably arranged at the engine crankcase as detailed above. The thermal equalization of the articulated piston, particularly at the piston crown is achieved by including a piston skirt defined by an upper recessed tray facing upwardly and open to the hollow cavity, extending for at least the peripheral quarter containing the cooling liquid inlet and defined by a pair of side walls substantially axially disposed with lower ends that meet a bottom radially inwardly and peripherally inclined towards the surface diametrically opposed to the cooling liquid inlet for conveyance of oil collected from the hollow cavity of the crown to that uncooled portion of the crown.

Still according to the present invention, the skirt thickness at the thrust surfaces is varied thus providing the motional equalization of an articulated piston which is shaped in harmonious fashion with respect to the loads received along the piston travel. This leads to the reduction of undesirable secondary movements due to better weight balance and reduced overall weight and is achieved by reducing the thickness of the non-thrust surface as compared to that of the thrust surface.

Even with these modifications, it is still possible to produce piston skirts by gravity die casting having substantially reduced porosity.

The aforementioned features of the invention will be more fully understood from the following description of a preferred embodiment of the invention appreciated together with the accompanying drawing figures which is not intended to unduly limit the scope of the invention.

BRIEF DRAWING DESCRIPTION

DETAILED DESCRIPTION OF THE INVENTION

Figure 1:
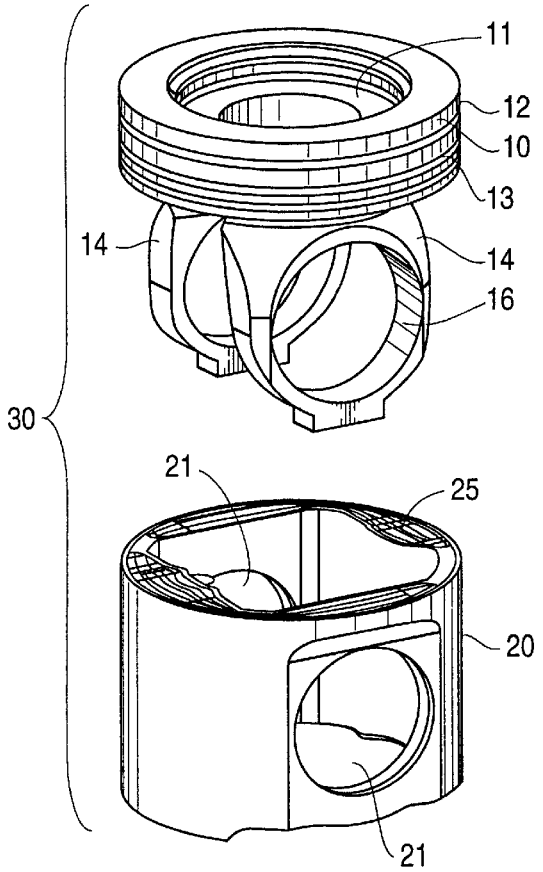
FIG. 1 is a perspective view of a piston crown and a piston skirt whose assembly comprises a preferred embodiment of the present invention.
Figure 3:
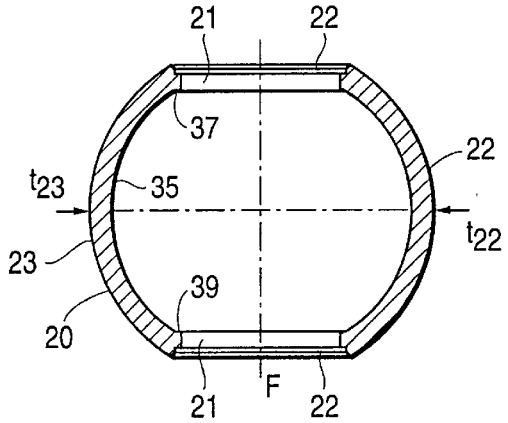
FIG. 3 is a cross-sectional view taken along the lines III—III of FIG. 2.
Figure 2:
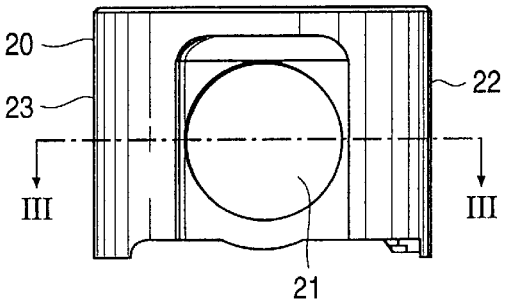
FIG. 2 is a side elevational view of the skirt of FIG. 1.

Referring to the several figures, a piston according to a preferred embodiment of the present invention is generally comprised of a piston crown 10 and a piston skirt 20 whose assembly results in an articulated piston 30.

The piston crown 10 comprises a combustion chamber 11 formed in an upper surface thereof. Pending from the crown periphery there is a leg 12 outwardly surrounded by at least one and preferably a plurality of ring grooves 13 for receiving piston rings (not shown) in a known manner. At the crown inner surface there is a pair of pin bosses 14 formed thereon defining with the leg 12 a hollow cavity 15 opening downwardly and extending around the circumference of the crown 10 between the bosses 14 and the leg 12. This feature being illustrated in FIG. 5.

Figure 5:
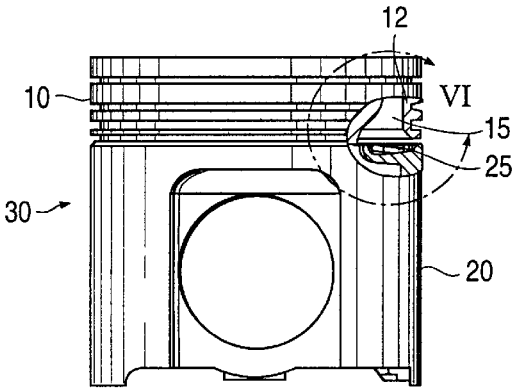
FIG. 5 is a side elevational view of the assembly of the piston crown and piston skirt of FIG. 1.

The piston skirt 20 includes a first longitudinal plane F containing a pair of opposed bores 21 for receiving a wrist pin (not shown) for connection to bores 16, the bosses 14 of the crown 10 resulting in the articulated piston 30 shown in FIG. 5. As is conventional, the bores 21 include ring grooves 22 which aid in positioning and securing the wrist pin in place.

For the purpose of improving the cooling properties at the piston crown 10, a peripheral tray 25 is produced, e.g. by a corresponding casting die, at the upper portion of the piston skirt 20, such tray 25 being open towards the hollow cavity 15 so as to partially enclose the same, thus forming a cooling gallery. The tray 25 being best illustrated in FIGS. 4 and 6.

As mentioned hereinabove, the skirt 20 has a first longitudinal plane indicated by F containing the pair of opposed bores 21 for receiving the wrist pin (not shown) for connection to the bosses 14, thus laterally dividing the skirt 20 in two semi cylindrical sections, one portion including a thrust surface 22 and the other including non thrust surface 23. Dynamics of an articulated piston 30 running in a cylinder (not shown) leads the thrust surface 22 to receive a greater load than does the non thrust surface 23. Accordingly, the non thrust surface 23 has a radial thickness $t_{23}$ that is less than the corresponding radial thickness $t_{22}$ of the thrust surface 22. In this regard, the non thrust surface is reduced by tapering the inner wall 35 of the skirt below the tray 25 for the length of the skirt between a bends 37 and 39 tangent to the opposing bores. Further to an equalization in terms of load, this difference in thickness provides better motional equalization of the skirt 20. In fact, considering all the parameters involving piston dynamics such as angular velocity, the weight of piston etc., the aforementioned effects are best realized and equalized when the thickness $t_{23}$ of the non thrust surface 23 is from $0.5*t_{22}$ to $0.95*t_{22}$, and more preferably when the thickness $t_{23}$ of the non thrust surface 23 is $0.75*t_{22}$, the symbol "*" standing for multiplication.

Accordingly, it is possible to manufacture the piston skirt 20, using conventional manufacturing processes such as gravity casting, having a reduced side wall thickness thereby reducing the costs of the overall piston while still providing a skirt which is capable of withstanding the forces exerted on the skirt during operation. That is, the thrust surface 22 would be of a thickness suitable for operating under conditions dictated by the internal combustion engine in which the piston is to be placed while the thickness of the non thrust surface 23 may be much less resulting in material cost savings without diminishing the performance of the skirt. Further, with the reduced thickness of the non thrust surface 23, the overall weight of the engine is similarly reduced.

Intersecting the first plane F of the skirt 20 is a second imaginary longitudinal plane S positioned perpendicular to plane F thereby defining four peripheral quarters of the skirt 20, at least one of which contains a cooling medium inlet 24. To improve the cooling properties of the crown 10, the tray 25 is inclined radially inwardly from the outer surface of the tray 25 and circumferentially toward the quarter diametrically opposed to the cooling medium inlet 24 as shown by the arrows A and B of FIG. 4A.

When the engine (not shown) is running a cooling medium such as lubricating oil is injected in a conventional manner by a nozzle (not shown) against the hollow cavity 15 formed in the piston crown 12, through the oil inlet 24 provided axially along the skirt 20, thus partially removing heat from that region. At least a portion of the oil impinged against the hollow cavity 15 flows down and is collected by the tray 25. Due to the inclination of tray 25 and reciprocating motion of the piston 30, respectively, oil collected from the cavity 15 is better distributed around the tray 25. Further, when impacting against and around the cavity 15 in a shaker type fashion, the removal of heat from the crown 10 is increased leading to the thermal equalization of the articulated piston 30.

Owing to characteristics such as cooling oil viscosity, tilting motion intervals and others pertaining to the piston dynamics, it has been found that an improved thermal equalization of the piston 30 is reached when the bottom of the tray 25 is inclined 1 degree to 10 degrees toward the quadrant opposed to the oil inlet 24 and preferably 2 degrees to 6 degrees toward such quadrant. More specifically, it has been found that an improved thermal equalization of the piston 30 is reached when the bottom of the tray 25 is inclined 4 degrees toward the quadrant opposed to the oil inlet 24.

Figure 6:
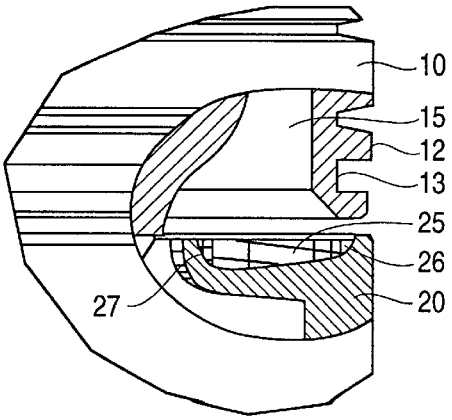
FIG. 6 is an expanded view of encircled section VI of FIG. 5.

The above-noted feature being best illustrated in FIGS. 5–12. Initially, FIGS. 5 and 6 illustrate the cross-sectional view taken along line V—V of FIG. 4B wherein it can be readily seen that the tray 25 is inclined downwardly from an outer periphery or side wall 26 toward an inner periphery or side wall 27 of the tray 25. As discussed hereinabove, this allows for greater and more efficient distribution of the coolant medium which is collected in the tray 25.

Figure 4A:
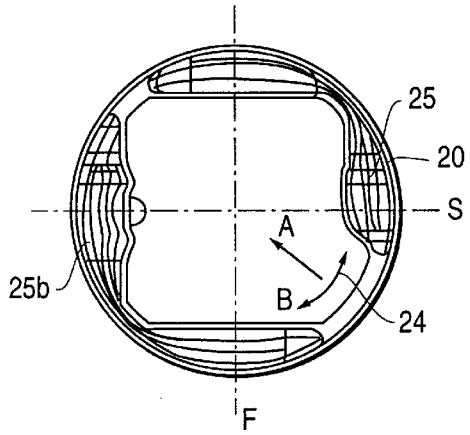
FIG. 4A is a top view of the skirt of FIG. 1.
Figure 4B:
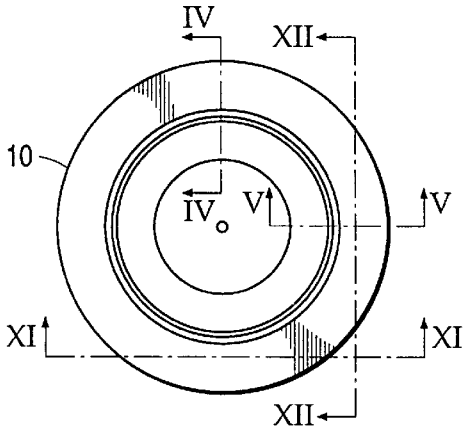
FIG. 4B is a top view of the crown of FIG. 1.
Figure 7:
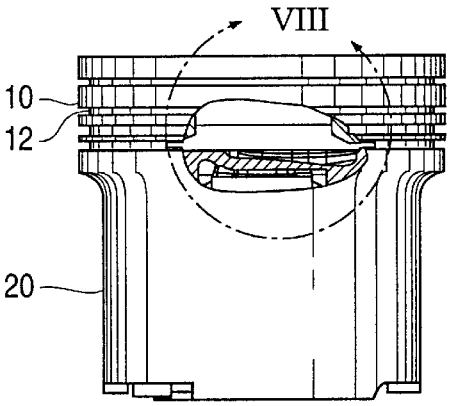
FIG. 7 is a side elevational view of the assembly of the piston crown and piston skirt of FIG. 1 rotated 90° from the position illustrated in FIG. 5.
Figure 8:
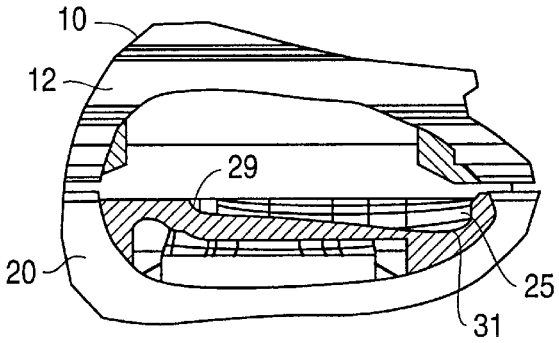
FIG. 8 is an expanded view of encircled section VII of FIG. 7.

Referring to FIGS. 7 and 8, which is viewed in accordance with the cross-sectional lines VII—VII of FIG. 4B, the tray 25 is inclined in a direction away from the oil inlet 24. As discussed hereinabove, this inclination is in the range of 1° to 10°, more specifically in the range 2° to 6° and preferably 4°. As is readily apparent from FIG. 8, the initial point 29 of the tray 25 is of a depth significantly less than that of the point 31 illustrated therein. Accordingly, the coolant medium which is caught in the tray 25 will be displaced about the perimeter of the skirt 20 by way of the inclination of the tray 25.

Figure 9:
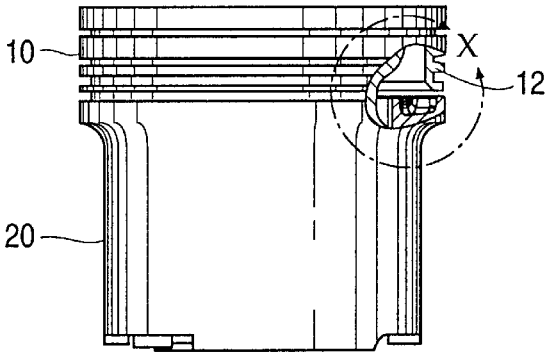
FIG. 9 is a side elevational view of the assembly of the piston crown and piston skirt of FIG. 1.
Figure 10:
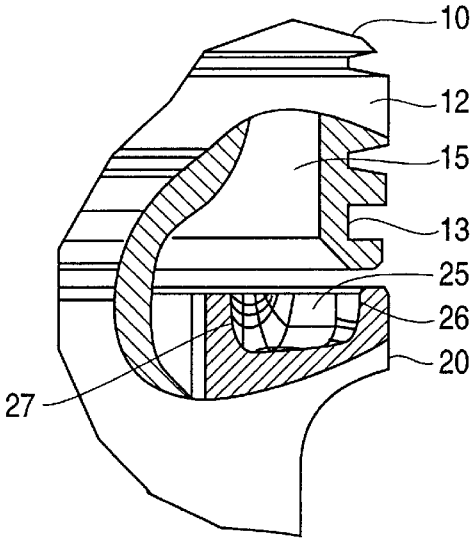
FIG. 10 is an expanded view of encircled section IX of FIG. 9.

Referring now to FIGS. 9 and 10 which are taken along cross-sectional line IX—IX of FIG. 4B, it is readily apparent that the depth of the tray 25 has increased significantly as compared to that illustrated in FIGS. 5 and 6. Likewise, the tray 25 is inclined downwardly toward the central axis of the piston skirt 20 as exemplified by the depth at the inner periphery or side wall 27 of the tray 25 being greater than the depth at the outer periphery or side wall 26 of the tray 25. Again, such inclination aids in the dispersion of the coolant medium within the tray 25.

Figure 11:
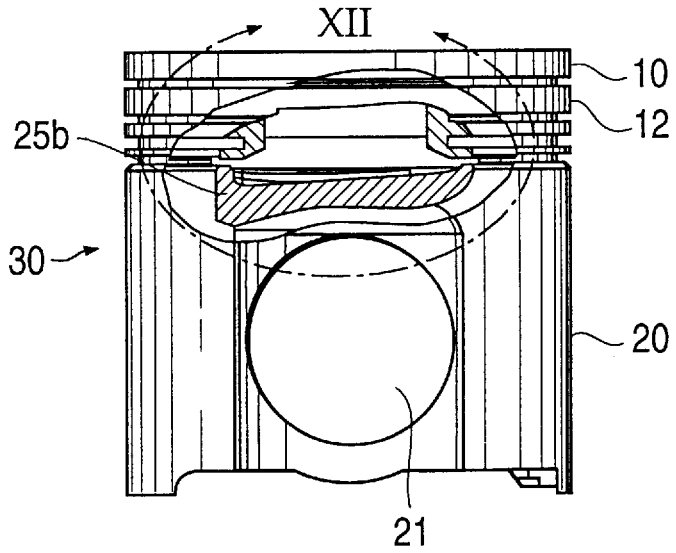
FIG. 11 is a side elevational view of the assembly of the piston crown and piston skirt of FIG. 1 rotated 90° from the position illustrated in FIG. 9.
Figure 12:
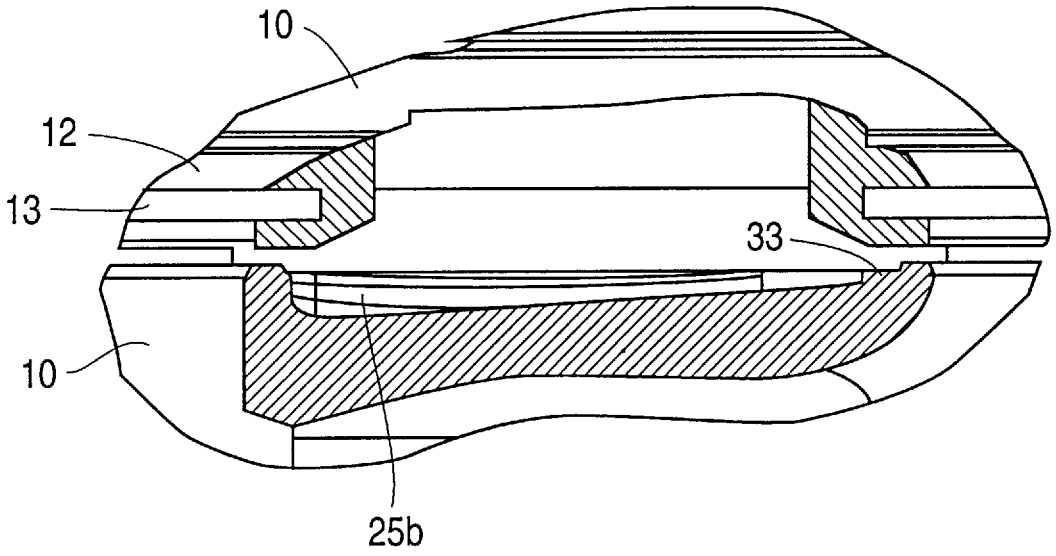
FIG. 12 is an expanded view of encircled section XI of FIG. 11.

As is apparent from FIG. 4A, the coolant tray 25 is actually divided in to two diametrically opposed coolant trays or reservoirs 25 and 25B, each of which are inclined away from the oil inlet 24 as well as being inclined inwardly toward the central axis of the piston skirt 20. The coolant trays or reservoirs 25 and 25B being separated by hubs projecting upwardly from the skirt 20. The inclination of the tray 25B away from the oil inlet 24 is best illustrated in FIGS. 11 and 12. Similar to that illustrated in FIG. 5, the tray 25B is inclined from an initial point 33 away from the oil inlet 24. As with the tray 25, the tray 25B is likewise inclined in a range of 1° to 10°, more specifically in a range of 2° to 6° toward the quadrant opposed from the inlet 24 and preferably, the tray 25B is inclined approximately 4° toward the quadrant opposed to the oil inlet 24. Accordingly, like the tray 25, the tray 25B aids in the distribution of the coolant medium about the periphery of the skirt 20 thus better distributing the coolant medium and increasing the thermal equalization of the articulated piston 30 by providing more coolant medium in the quadrant opposed to the quadrant including the oil inlet 24.

Accordingly, by manufacturing an articulated piston in accordance with the foregoing, the articulated piston will exhibit improved thermal equalization as well as improved motional equalization. As noted hereinabove, the piston skirt serves two central functions, the first being to guide the piston assembly in the cylinder and the second being to aid in the cooling of the piston crown. The piston skirt is subjected to thrust loading as it guides the piston crown in the cylinder and as such is carried out, the thrust loading is higher on the major thrust side of the piston. Typically, the piston skirt design utilizes a uniform thrust wall of thickness, however, as mentioned hereinabove, applicants achieved greater success when the skirt design incorporates a major thrust side wall of a thickness which is capable of withstanding thrust loads and a minor or non thrust side wall of a thickness which is 5% to 50% thinner than that of the major thrust side wall. This feature attributes significantly to the motional equalization of the articulated piston.

Similarly, in order to aid in the shaker effect of the cooling medium entrained in the tray provided in the piston skirt, the tray is inclined downwardly circumferentially away from the point at which the cooling medium is sprayed into the cooling gallery. Likewise, the tray is sloped radially inwardly toward the axis of the piston skirt to further aid in the dispersion of the coolant medium within the tray. Each of the foregoing aspects resulting in an articulated piston exhibiting improved reliability and durability which is suitable for use in heavy duty diesel engines.

While the present invention has been described with reference to a preferred embodiment, it will be appreciated by those skilled in the art that the invention may be practiced otherwise than as specifically described herein without departing from the spirit and scope of the invention. It is, therefore, to be understood that the spirit and scope of the invention be limited only by the appended claims.

We claim:

1. An articulated piston comprising:

a piston crown having an outer surface, a peripheral pending side wall and an inner surface including a pair of pin bosses extending downwardly from said inner surface with said inner surface and said pin bosses defining a hollow cooling cavity opening downwardly and extending about a circumference of said piston crown;

a piston skirt having a longitudinal plane containing a pair of diametrically opposed bores for receiving a wrist pin for connection to the bosses of the crown and defining a semi-cylindrical thrust surface and a semi-cylindrical non thrust surface;

wherein a thickness of said non thrust surface is less than a thickness of said thrust surface.

2. An articulated piston as in claim 1, wherein the thickness of the skirt at the non thrust surface is reduced by tapering at least a portion of an inner wall of the skirt over a length of the skirt between bends tangent to the opposed holes.

3. An articulated piston as in claim 2, wherein the thickness of the skirt at the non thrust surface is from 5% to 50% less than the thickness of the skirt at the thrust surface.

4. An articulated piston as in claim 3, wherein the thickness of the skirt at the non thrust surface is 25% less than the thickness of the skirt at the thrust surface.

5. An articulated piston comprising:

a piston crown having an outer surface, a peripheral pending side wall and an inner surface including a pair of pin bosses extending downwardly from said inner surface with said inner surface and said pin bosses defining a hollow cooling cavity opening downwardly and extending about a circumference of said piston crown; and a piston skirt, said piston skirt including;

a first longitudinal plane containing a pair of diametrically opposed bores for receiving a wrist pin for connection to the bosses of the crown and defining two semi-cylindrical thrust and non thrust surfaces with a thickness of said non thrust surface being less than a thickness of said thrust surface;

a second longitudinal plane, perpendicular to the first plane thereby defining four peripheral quarters of said piston skirt, at least one of the quarters containing a cooling medium inlet through which a cooling medium injected by a nozzle can pass and impinge against said hollow cavity of the piston crown for cooling said crown; and a recessed tray formed in an upper surface of said piston skirt facing upwardly and open to said hollow cavity, said recessed tray extending for at least the peripheral quarter containing the cooling medium inlet and defined by a pair of substantially axially disposed side walls and a bottom wall extending radially between said side walls;

wherein said recessed tray is peripherally inclined towards a quarter diametrically opposed to the cooling medium inlet for conveyance of the cooling medium collected from said hollow cavity of the crown toward said diametrically opposed quarter.

6. An articulated piston as in claim 5, wherein the tray extends radially under the inner surface of the crown and comprises two diametrically opposed reservoirs, said reservoirs being separated by hubs projecting upwardly from said skirt.

7. An articulated piston as in claim 6, wherein the bottom of the tray is inclined from 1 to 10 degrees with respect to the upper surface of said piston skirt.

8. An articulated piston as in claim 7, wherein the bottom of the tray is inclined from 2 to 6 degrees with respect to the upper surface of said piston skirt.

9. An articulated piston as in claim 8, wherein the bottom of the tray is inclined in 4 degrees from with respect to the upper surface of said piston skirt.

10. An articulated piston as defined in claim 5, wherein said bottom wall is inclined radially inwardly between said side walls.

11. An articulated piston as in claim 5, wherein the thickness of the skirt at the non thrust surface is reduced by tapering at least a portion of an inner wall of the skirt below the tray over a length of the skirt between bends tangent to the opposed holes.

12. An articulated piston as in claim 11, wherein the thickness of the skirt at the non thrust surface is from 5% to 50% less than the thickness of the skirt at the thrust surface.

13. An articulated piston as in claim 12, wherein the thickness of the skirt at the non thrust surface is 25% less than the thickness of the skirt at the thrust surface.

14. An articulated piston comprising:

a piston crown having an outer surface, a peripheral pending side wall and an inner surface including a pair of pin bosses extending downwardly from said inner surface with said inner surface and said pin bosses defining a hollow cooling cavity opening downwardly and extending about a circumference of said piston crown; and a piston skirt, said piston skirt including;

a first longitudinal plane containing a pair of diametrically opposed bores for receiving a wrist pin for connection to the bosses of the crown and defining two semi-cylindrical sections of said piston skirt;

a second longitudinal plane, perpendicular to the first plane thereby defining four peripheral quarters of said piston skirt, at least one of the quarters containing a cooling medium inlet through which a cooling medium injected by a nozzle can pass and impinge against said hollow cavity of the piston crown for cooling said crown; and a recessed tray formed in an upper surface of said piston skirt facing upwardly and open to said hollow cavity, said recessed tray extending for at least the peripheral quarter containing the cooling medium inlet and defined by a pair of substantially axially disposed side walls and a bottom wall extending radially between said side walls;

wherein said recessed tray is peripherally inclined towards a quarter diametrically opposed to the cooling medium inlet for conveyance of the cooling medium collected from said hollow cavity of the crown toward said diametrically opposed side walls.

15. An articulated piston as in claim 14, wherein the tray extends radially under the inner surface of the crown and comprises two diametrically opposed reservoirs, said reservoirs being separated by hubs projecting upwardly from said skirt.

16. An articulated piston as in claim 15, wherein the bottom of the tray is inclined from 1 to 10 degrees with respect to the upper surface of said piston skirt.

17. An articulated piston as in claim 15, wherein the bottom of the tray is inclined from 2 to 6 degrees with respect to the upper surface of said piston skirt.

18. An articulated piston as in claim 17, wherein the bottom of the tray is inclined in 4 degrees from with respect to the upper surface of said piston skirt.

19. An articulated piston as defined in claim 18, wherein said bottom wall is inclined radially inwardly between said side walls.

20. An articulated piston as in claim 14, wherein a thickness of said piston skirt is varied about a circumference of said piston skirt.

21. An articulated piston as defined in claim 20, wherein one of said semi-cylindrical sections includes a thrust surface and the other of said semi-cylindrical sections includes a non thrust surface with a thickness of said non thrust surface being less than a thickness said thrust surface.

22. An articulated piston as defined in claim 21, wherein the thickness of said non thrust surface is reduced by tapering at least a portion of an inner wall of the skirt below the tray over a length of the skirt between bends tangent to the opposed bores.

23. An articulated piston as in claim 22, wherein the thickness of said piston skirt at the non thrust surface is from 5% to 50% less than the thickness of the skirt at the thrust surface.

24. An articulated piston as in claim 23, wherein the thickness of said piston skirt at the non thrust surface is 25% less than the thickness of the skirt at the thrust surface.

* * * * *